US005556364A

United States Patent [19]

Konzal

[11] Patent Number: 5,556,364

[45] Date of Patent: Sep. 17, 1996

[54] CUP BOTTOM INCURL WORKSTATION FOR A CUP MAKING MACHINE

[75] Inventor: Daryl R. Konzal, Wauwatosa, Wis.

[73] Assignee: Paper Machinery Corporation, Milwaukee, Wis.

[21] Appl. No.: 310,833

[22] Filed: Sep. 22, 1994

[51] Int. Cl.[6] ..... B31B 1/74; B21D 51/32

[52] U.S. Cl. ..... 493/109; 493/156; 493/159; 413/6; 413/31

[58] Field of Search ..... 413/4, 6, 31, 35; 493/109, 156, 158, 159

[56] References Cited

U.S. PATENT DOCUMENTS 2,117,295 5/1938 Buckingham ..... 493/106
3,745,891 7/1973 Bodendoerfer .
4,349,345 9/1982 Bodendoerfer .
4,409,045 10/1983 Busse ..... 493/107
4,490,130 12/1984 Konzal et al. .
4,571,233 2/1986 Konzal .
5,324,249 6/1994 Konzal .

*Primary Examiner*—Jack W. Lavinder
*Attorney, Agent, or Firm*—Foley & Lardner

[57] ABSTRACT

A workstation for a use with a turret-type cup making machine is disclosed. The workstation is designed for use in making containers, such as paperboard style cups. The workstation includes a rotatable roller assembly and a rotationally stationary guide member which cooperate to curl the sidewall blank with respect to the bottom blank. The rollers and guide member have adjacent surfaces designed to curl the bottom edge of a sidewall blank around a lip of the bottom blank and back into the recessed area at the bottom of the container.

20 Claims, 7 Drawing Sheets

CUP BOTTOM INCURL WORKSTATION FOR A CUP MAKING MACHINE

FIELD OF THE INVENTION

The present invention relates generally to a workstation for use with a turret-type cup or container making machine, and particularly to a workstation for curling inwardly the bottom edge of the sidewall blank over the bottom blank prior to forming a seal therebetween.

BACKGROUND OF THE INVENTION

Cup making machines, such as those manufactured by Paper Machinery Corporation of Milwaukee, Wis., USA are used to make a variety of cups and containers. A typical cup machine for making paperboard cups, for instance, includes a turret having a plurality of mandrels about which the containers are formed. The turret sequentially rotates the mandrels into cooperation with a variety of workstations where numerous cup forming procedures occur.

In an exemplary procedure, a circular bottom blank is cut at one workstation and attached to the end of a mandrel by a vacuum applied through the mandrel. During this procedure, the outside edge or lip of the bottom blank is folded downwardly. At a subsequent workstation, a sidewall blank is wrapped around the mandrel. The sidewall blank is heated and sealed along a seam which runs generally longitudinally along the side of the cup. (Typically the paperboard is coated with a thermoplastic material, such as polypropylene, so the blanks may be heated and sealed together.)

The sidewall blank extends transversely to the bottom blank except along the lip which runs approximately parallel with the sidewall blank. In some applications, the sidewall blank includes a flap extending beyond the lip of the bottom blank, and the bottom edge of this flap is curled over the lip at an incurl station. Then, at a bottom finishing station, the flap is pressed against the lip from an inside recessed area of the bottom of the cup. By heating the thermoplastic material and firmly pressing the sidewall, sidewall flap, and bottom blank lip together, a seal is formed and the cup is provided with a sturdy bottom region having a recessed area.

There also may be other workstations where various additional cup forming procedures are carried out. For example, one station may be used to provide a curl at the top of the cup to provide a more functional drinking container and a better appearance.

At a typical cup bottom incurl workstation, the bottom edge of the sidewall blank flap is first curled inwardly and then directed into the recessed area at the bottom of the cup. In other words, the sidewall blank flap is effectively folded over the lip of the bottom blank. Conventionally, the incurling of the bottom edge of the sidewall blank is accomplished by a plurality of spool-like rollers having a recessed center region configured to force the bottom edge inwardly and then back into the recessed bottom of the cup when the mandrel and the incurl workstation are moved towards one another.

The rollers are relatively small in diameter and are mounted in the incurl workstation on a rotatable roller assembly. The rollers are spaced so the bottom edge of the sidewall blank first contacts an outermost sloped surface of the recessed center region. The surface directs the edge inwardly and then around an arcuate surface and back towards the bottom blank along the innermost sloped surface, innermost being defined as closest to the longitudinal axis of the cup.

During this curling of the sidewall blank flap, the roller assembly is rotated relatively rapidly to move the rollers along the bottom edge to evenly curl the flap into the recessed area around the entire bottom. However, even though this arrangement works relatively well in many applications, the movement of the rollers around the bottom edge can mar the flap area by both destroying the thermoplastic coating and rendering any printing or logos illegible. This is problematic because cup manufacturers often print an identification line on the sidewall blank flap that must remain readable after the cup bottom is formed. The movement of the rollers about the perimeter of the cup bottom can scuff this identification line to a point where it is no longer readable. Thus, it would be advantageous to create an incurl workstation that permitted the bottom flap to be curled over the bottom blank lip and into the recessed area of the cup bottom without marring the identification line or harming the thermoplastic coating.

SUMMARY OF THE INVENTION

The present invention features a cup bottom incurl workstation of the type for use with a cup making machine. The machine includes a rotating turret having a plurality of mandrels, and each mandrel is coordinated to move into a position registered with the cup bottom incurl station. The registered mandrel is also designed to receive a bottom blank having an outer lip and a sidewall blank including a flap that is curled inwardly over the outer lip. This creates a recessed area in the bottom of the cup.

The bottom incurl workstation comprises a central flap guide having a peripheral surface for guiding the bottom blank flap. Additionally, a rotatable roller assembly is configured to direct the bottom flap to the central flap guide as the adjacent mandrel and cup bottom incurl station move towards one another. The roller assembly includes a plurality of rollers disposed to contact a bottom edge of the flap. Each roller has an arcuate surface extending into cooperation with the peripheral surface of the central flap guide. As the adjacent mandrel moves closer to the plurality of rollers and the flap guide, the bottom edge of the flap is first directed inwardly along the arcuate surfaces of the rollers until contact is made with the peripheral surface. This peripheral surface is shaped to further guide the flap into the recessed area of the cup as the mandrel continues to move closer to the plurality of rollers and the flap guide.

According to another aspect of the invention, a method is disclosed for forming the bottom of a container of the type having a bottom blank and a sidewall blank. The method includes the step of creating a lip on the bottom blank and wrapping a sidewall blank around the bottom blank so a bottom edge of the sidewall blank extends beyond the lip. The method further includes forcing the bottom edge of the sidewall blank against a plurality of rollers having arcuate surfaces for directing the bottom edge inwardly. According to this method, the rollers are rolled along the entire cup bottom perimeter. Then, the bottom edge is forced against a stationary surface shaped to direct the bottom edge back towards the bottom blank.

DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
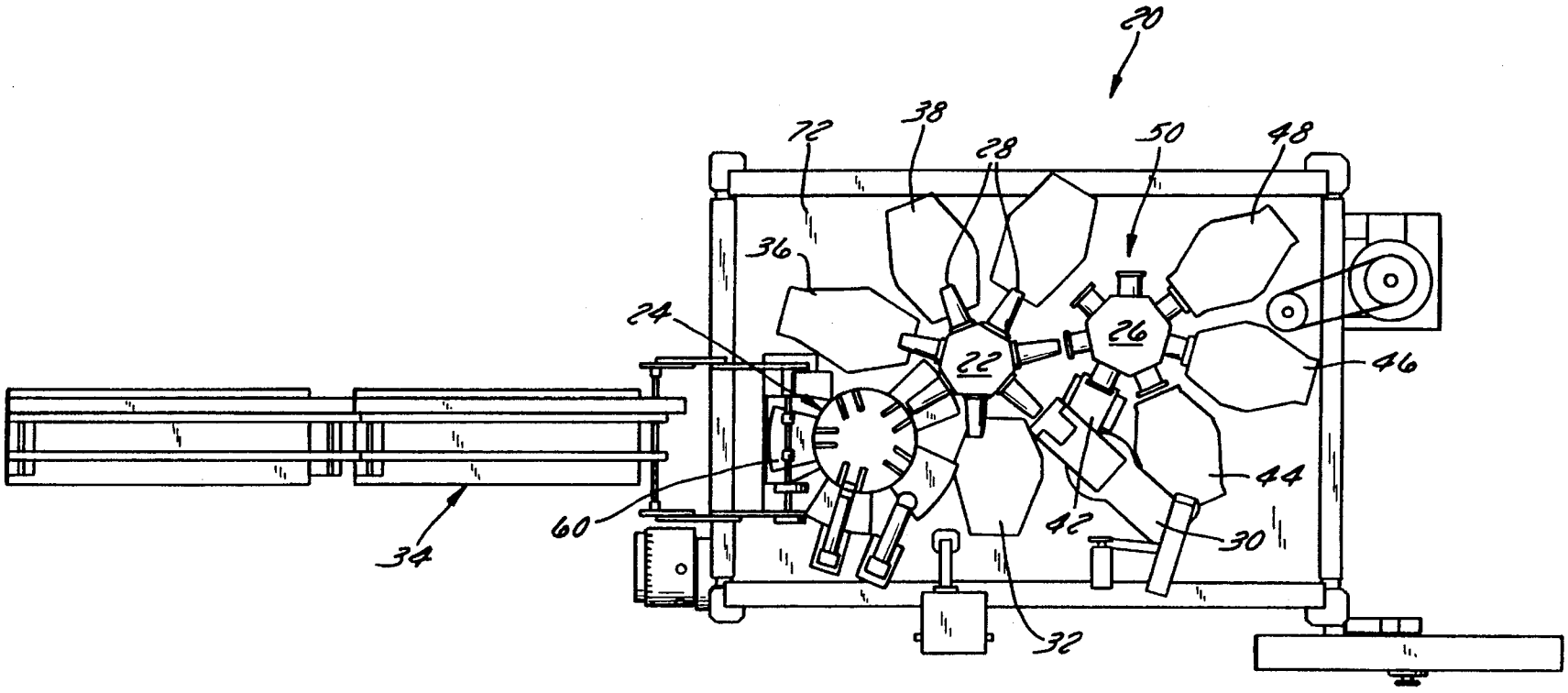
FIG. 1 is a schematic top plan view of a cup making machine incorporating the present invention, having a variety of exemplary workstations disposed about the mandrel turret.

Referring generally to FIG. 1, an exemplary cup making machine 20 is illustrated. This particular design includes a mandrel turret 22 which cooperates with a transfer turret 24 and a rimming turret 26. Mandrel turret 22 includes a plurality of mandrels 28 that are rotated in a stepwise or indexing manner between surrounding workstations. For example, a bottom blank may be applied to a given mandrel 28 at a bottom blank maker workstation 30 and then rotated to a bottom reformer station 32. From this point, the mandrel 28 is rotated into cooperation with the transfer turret 24 which receives sidewall blanks from a hopper 34 and rotates the sidewall blank into cooperation with an adjacent mandrel 28. The sidewall blank is then folded about the mandrel over the bottom blank, heated and sealed along a seam.

Next, the bottom blank and sidewall blank are rotated to a bottom heat station 36. After heating, mandrel turret 22 indexes the subject mandrel 28 into registration with a roller incurl workstation 38 where a portion of the sidewall blank, i.e. a sidewall blank flap, is bent over an outer lip of the bottom blank to form a recessed bottom in the cup. The cup is then moved to a bottom finish station 40 where the sidewall blank flap and the bottom blank lip are pressed against the lower region of the sidewall blank to form a seal.

Once the bottom is formed and sealed, the cup is transferred to rimming turret 26, rotated to a lube station 42 and then rotated to a rimming precurl station 44 where the upper lip of the sidewall is curled outwardly. From that station, the cup is indexed to a rimming finish curl station 46 which finishes the curled portion along the top of the cup to make an attractive edge. At this point, the cup may be moved to an optional lid groover station 48 and then to a cup blowoff station 50 for removal of the finished cup.

The above-described cup making machine is one example of many that could incorporate an incurl workstation 38 according to the present invention, as will be described. Different arrangements of workstations may be used on other cup making machines. For example, some cup making machines use a single turret with additional rimming stations disposed about the single turret. All are equally adaptable, to incorporate the bottom finish technique of the present invention.

Figure 3:
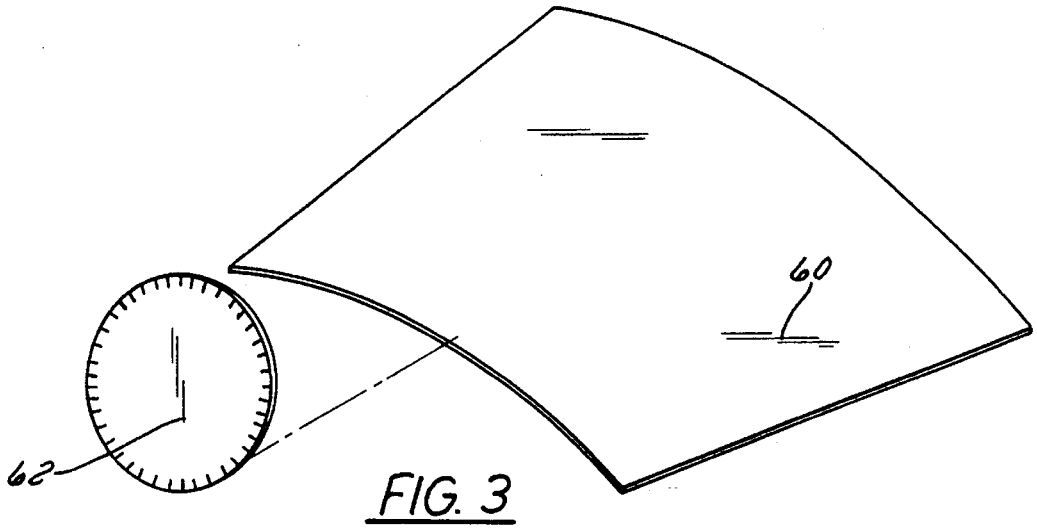
FIG. 3 is a schematic representation of the bottom blank and the sidewall blank which are combined to form the cup shown in FIG. 1.
Figure 2:
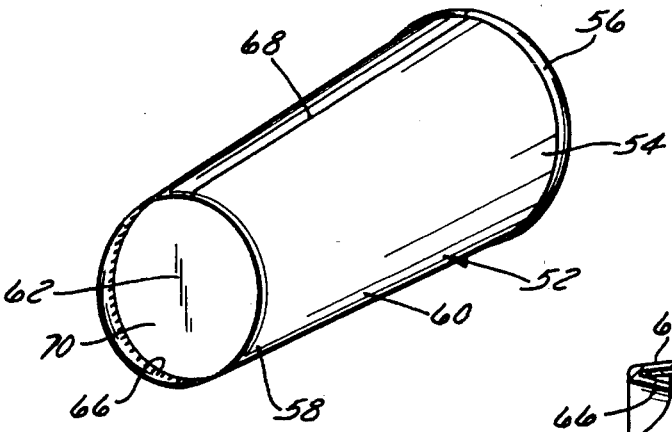
FIG. 2 is a perspective view of one type of cup that may be made on the cup making machine shown in FIG. 1.
Figure 4:
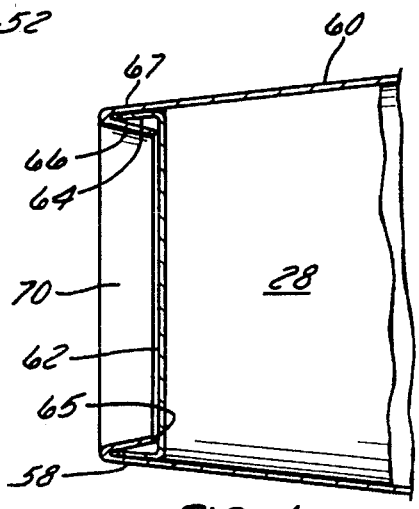
FIG. 4 is a cross-sectional view showing the area at which the sidewall blank is joined to the bottom blank, forming the cup shown in FIG. 1.

Cup bottom incurl workstation 38 can be sized and designed to make a variety of cups, and one example is illustrated in FIGS. 2–4. An exemplary cup 52 includes an upper region 54 having a curled rim 56 and a bottom region 58. Cup 52 is made from a sidewall blank 60 which is wrapped around a bottom blank 62 disposed generally transverse thereto. Bottom blank 62 is typically bent or folded over in proximity to its outer edge to form a lip 64. The sidewall blank 60 is located with respect to bottom blank 62 so that a flap portion 66 having a bottom edge 65 extends beyond lip 64. Flap portion 66 is bent or folded around lip 65 so lip 64 may be squeezed between flap portion 66 and a lower region 67 of sidewall blank 60 (see FIG. 4).

A typical cup 52 is made from paperboard blanks having a thermoplastic coating, such as polypropylene. The thermoplastic material permits heating and sealing of adjacent components. For instance, when sidewall blank 60 is wrapped around bottom blank 62, the adjacent edges are heated and pressed together along a seal 68. Similarly, lip 64, flap portion 66, and lower region 67 of sidewall blank 60 may be heated and pressed together at bottom finish station 40 to form a strong, leak-proof bottom region 58. By forming cup 52 as illustrated in FIG. 4, a recessed area 70 is created in the bottom of cup 52 on an opposite side of bottom blank 62 from the main container region of cup 52. Recessed area 70 permits insertion of a tool to press lip 64 and flap portion 66 towards the lower region 67 of sidewall blank 60.

Referring generally to FIGS. 5–8, the preferred embodiment of cup bottom incurl workstation 38 is illustrated. Incurl station 38 includes a framework 72 to which an input shaft 74 is rotably mounted on a bearing such as roller bearing 75. Input shaft 74 may be driven according to a variety of conventional cup machine methods, including belts, chains or cam drives connected to a power source such as an electric motor (not shown).

A carriage 76 is slidably mounted on framework 72 to move into cooperation with each mandrel 28 when the subject mandrel 28 is indexed into registration with incurl station 38. A roller assembly 78 is rotatably mounted to carriage 76, and a central flap guide 80 is also mounted to carriage 76 and disposed for longitudinal movement generally into the recessed area 70 of cup 52. Preferably, central flap guide 80 is rotationally fixed so it does not scuff flap 66 as bottom edge 65 is directed back into recessed area 70 (See FIG. 6).

Roller assembly 78 preferably includes a tail section 82 that is rotatably mounted on bearings, such as roller bearings 84. Tail section 82 is connected to a support plate 86 by fasteners such as bolts 88. Tail section 82 and support plate 86 rotate about an axis 90 which is also the axis that extends longitudinally through central flap guide 80 and generally through the center point of bottom blank 62 when mounted on adjacent mandrel 28.

A plurality of roller brackets 92 are mounted to support plate 86 at positions radially outward from axis 90. Preferably, each roller bracket 92 is attached to an adjustment mechanism 94 that permits both longitudinal and radial adjustment of the position of the roller bracket. As illustrated, adjustment mechanism 94 may include a pair of threaded bolts 96 wherein each bolt 96 extends through support plate 86 and threadably engages roller bracket 92 at different orientations, e.g., 90° from each other, to permit adjustment of the roller bracket 92 along two different axes.

A roller 98 is mounted to each roller bracket 92 on bearings, such as roller bearings 100. Preferably, each roller 98 is mounted on a shaft 102 having a threaded end 104 extending through its corresponding roller bearing 100. Rollers 98 are retained on their corresponding roller brackets 92 by nuts 106 attached at threaded ends 104.

Figure 9:
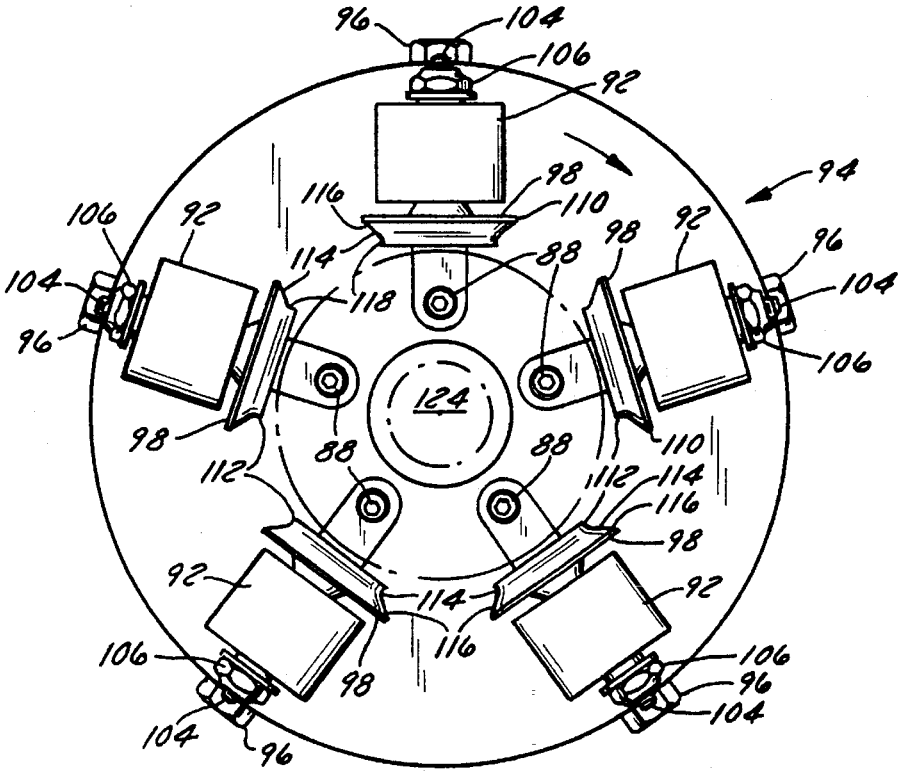
FIG. 9 is a front elevational view of the rollers.

The design of each roller 98 is important to permit curling of flap 66 without scuffing any printing, logos, or designs thereon. The preferred design of each roller 98 is similar to a half spool that rotates about a roller axis 108 generally aligned with shaft 102. Thus, an outer edge 110 of each roller 98 has a larger diameter than an inner edge 112, the inner edge 112 being the edge radially closer to axis 90 when rollers 98 are mounted on roller assembly 78. Extending between outer edge 110 and inner edge 112 is a surface 114 configured to guide the bottom edge 65 of flap portion 66 first radially inwardly along a generally sloped portion 116 of surface 114 and then around a generally arcuate portion 118 that directs bottom edge 65 to central flap guide 80 (see FIG. 9). In prior designs, the rollers were shaped as a full spool rather than a half spool and included a surface that directed flap 66 all the way into recessed area 70, but this design was unsatisfactory since it scuffed flap 66 when rollers 98 were rolled around the bottom edge of the cup often rendering any print illegible. Additionally, prior rollers were smaller in diameter, typically having a working diameter of approximately 5/16 inches. Rollers 98 preferably have working diameters ranging from ¾ inches to 1½ inches, and therefore require less energy to roll them around the bottom of cup 52. The larger rollers can also be combined with a slower rotational speed of roller assembly 78 which also reduces scuffing of flap 66. The preferred rotational speed of roller assembly 78 is approximately 300 to 600 revolutions per minute.

In the most preferred embodiment, there are five roller brackets 92 and five corresponding rollers 98 disposed equi-distant from one another, and the position of each roller 98 is adjusted to properly contact bottom edge 65 of flap 66. As mandrel 28 and incurl station 38 are moved towards one another, bottom edge 65 generally contacts rollers 98 simultaneously along sloped portion 116. Thus, as incurl station 38 and mandrel 28 continue to move towards one another, bottom edge 65 is guided inwardly and then curled back towards bottom blank 62 along roller surface 114. During this guiding of bottom edge 65, the entire roller assembly 78 is rotating to roll or move rollers 98 along the entire bottom edge of the cup to appropriately curl the entire flap 66. Although the orientations of the rollers can be adjusted for different applications, the rollers are preferably oriented so each roller axis 108 is transverse to, and most preferably perpendicular to, axis 90 about which roller assembly 78 rotates.

Roller assembly 78 may be rotated by a variety of mechanisms, but preferably a pulley 119 is connected to tail section 82. Pulley 119 can be driven by a belt connected to a power source, such as an electric motor (not shown). However, other drive devices, such as gears, cams, or chains and sprockets could be used to rotate roller assembly 78.

In the typical application, cup 52 has a generally circular bottom, and central flap guide 80 has a generally circular perimeter sized to fit within recessed area 70. Preferably, central flap guide 80 includes a peripheral surface 120 disposed about the perimeter flap guide 80 and oriented to cooperate with surfaces 114 of the rollers 98. Peripheral surface 120 lies adjacent the inner edges 112 of rollers 98 to receive the bottom edge 65 of flap 66 as flap 66 is curled about arcuate portion 118 of roller surface 114. Preferably, peripheral surface 120 slopes slightly radially inwardly towards axis 90 to guide flap 66 into recess area 70 before the cup bottom is finished at cup bottom finishing station 40.

Central flap guide 80 includes a head 122 having a radial exterior defined by peripheral surface 120. Head 122 is preferably attached to a rod 124 by a fastener, such as bolt 126. Rod 124 extends through tail section 82 of roller assembly 78 which rotates about rod 124 via bearings, such as ball bearings 128. Rod 124 and head 122 are preferably rotationally stationary to prevent scuffing of flap 66 as bottom edge 65 is guided along peripheral surface 120. However, central flap guide 80 can be adjusted along its longitudinal axis, axis 90, by an adjustment bolt 130 threadably mounted in a guard 132 disposed over pulley 119.

Roller assembly 78 and central flap guide 80 are reciprocated into and out of cooperation with sidewall blank 60 and bottom blank 62 by a reciprocation assembly 134. Preferably, reciprocation assembly 134 includes a pair of cams 136 connected to input shaft 74 and having cam surfaces 138. A pair of cam followers 140 act against each cam surface 138 respectively. Cam followers 140 are attached to carriage 76 by a pair of fasteners 142, such as bolts 144 extending through bores 146 in carriage 76 and held in place by nuts 148. The profile of each cam surface 138 is generally the same but offset by 180°. Thus, by placing the cam followers 140 on opposite sides of cams 136, carriage 76 is reciprocated through one complete cycle for every rotation of input shaft 74.

Figure 10:
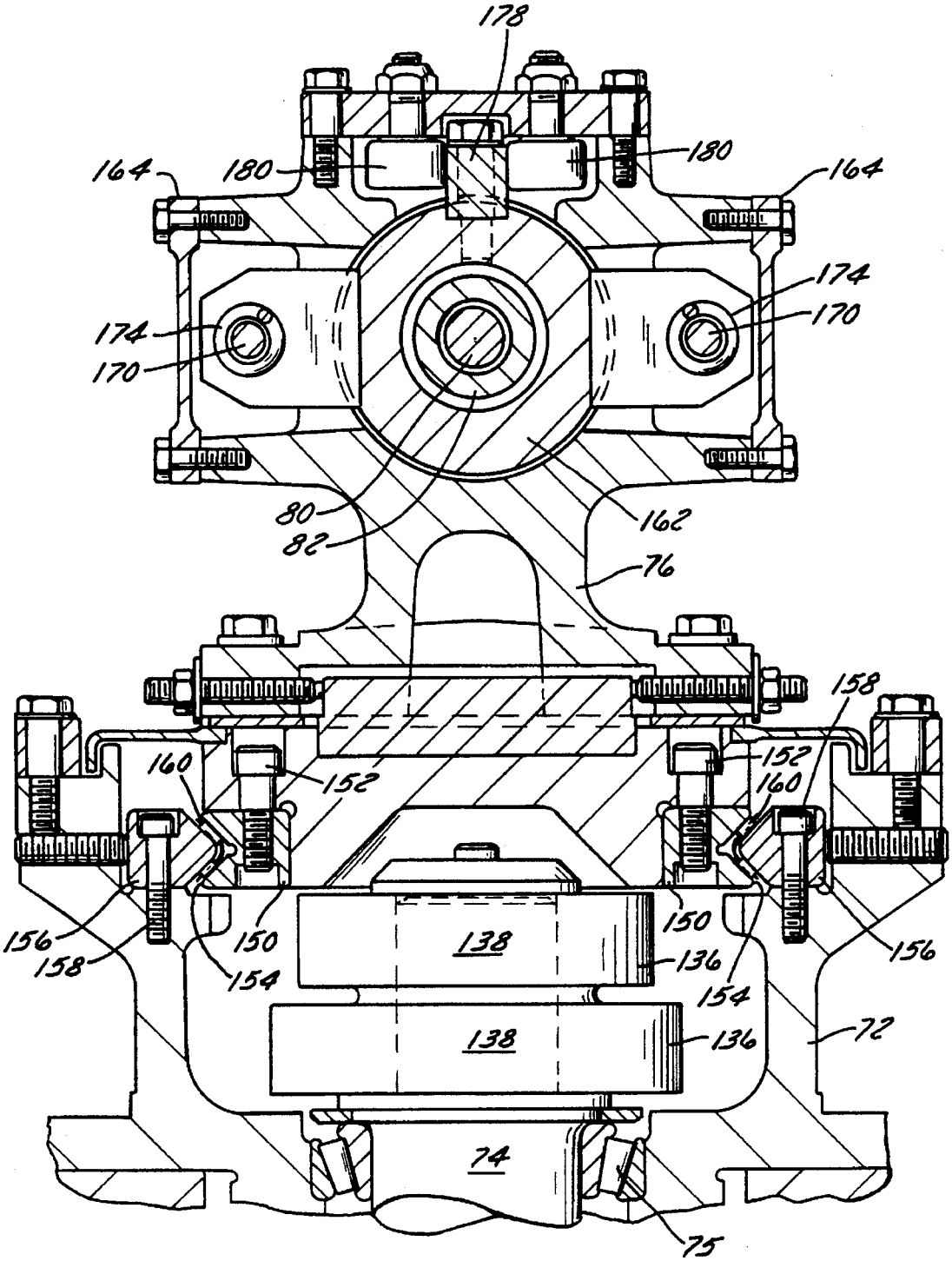
FIG. 10 is a cross-sectional view taken generally along line 10—10 of FIG. 6.

Carriage 76 is mounted to framework 72 for longitudinal sliding movement on a pair of slides and tracks (see FIG. 10). A pair of slides 150 are attached to carriage 76 by fasteners such as bolts 152 and preferably include a recessed V-portion 154. Each recessed V-portion 154 matingly engages a generally V-shaped track 156 attached to framework 72 by fasteners, such as bolts 158. Bearings, such as roller bearings 160, may be disposed between the recessed V-portion 154 and the V-shaped track 156 to facilitate the sliding motion of carriage 76 on framework 72. Configurations other than V-shaped configurations can also be used in the design of slides 150 and tracks 156 provided carriage 76 is securely and slidably mounted to framework 72.

Optionally, carriage 76 can be split into a spring-loaded carriage subassembly 162 and a carriage housing 164 rigidly mounted to framework 72. In this configuration, roller assembly 78 and central flap guide 80 are mounted to carriage subassembly 162 to avoid breakage if roller assembly 78 or central flap guide 80 strike a solid object. Carriage subassembly 162 is mounted to carriage housing 164 on a pair of thin slides 166.

Carriage housing 164 and carriage subassembly 162 are held together by a pair of spring mechanisms 168, preferably including a bolt 170 extending through a pair of bores 172 in carriage subassembly 162 and carriage housing 164, respectively. Carriage subassembly 162 is biased to its proper orientation on carriage housing 164 by springs 174 held over bolts 170 by adjustment nuts 176. During normal operation, the spring tension in springs 174 is sufficient to hold carriage subassembly 162 in its proper position for operation with respect to carriage housing 164. However, if central flap guide 80 or roller assembly 78 strikes a solid object, the biasing force of springs 174 is overcome and carriage subassembly 162 slides on thin slides 166 with respect to carriage housing 164 to prevent breakage of components.

Figure 5:
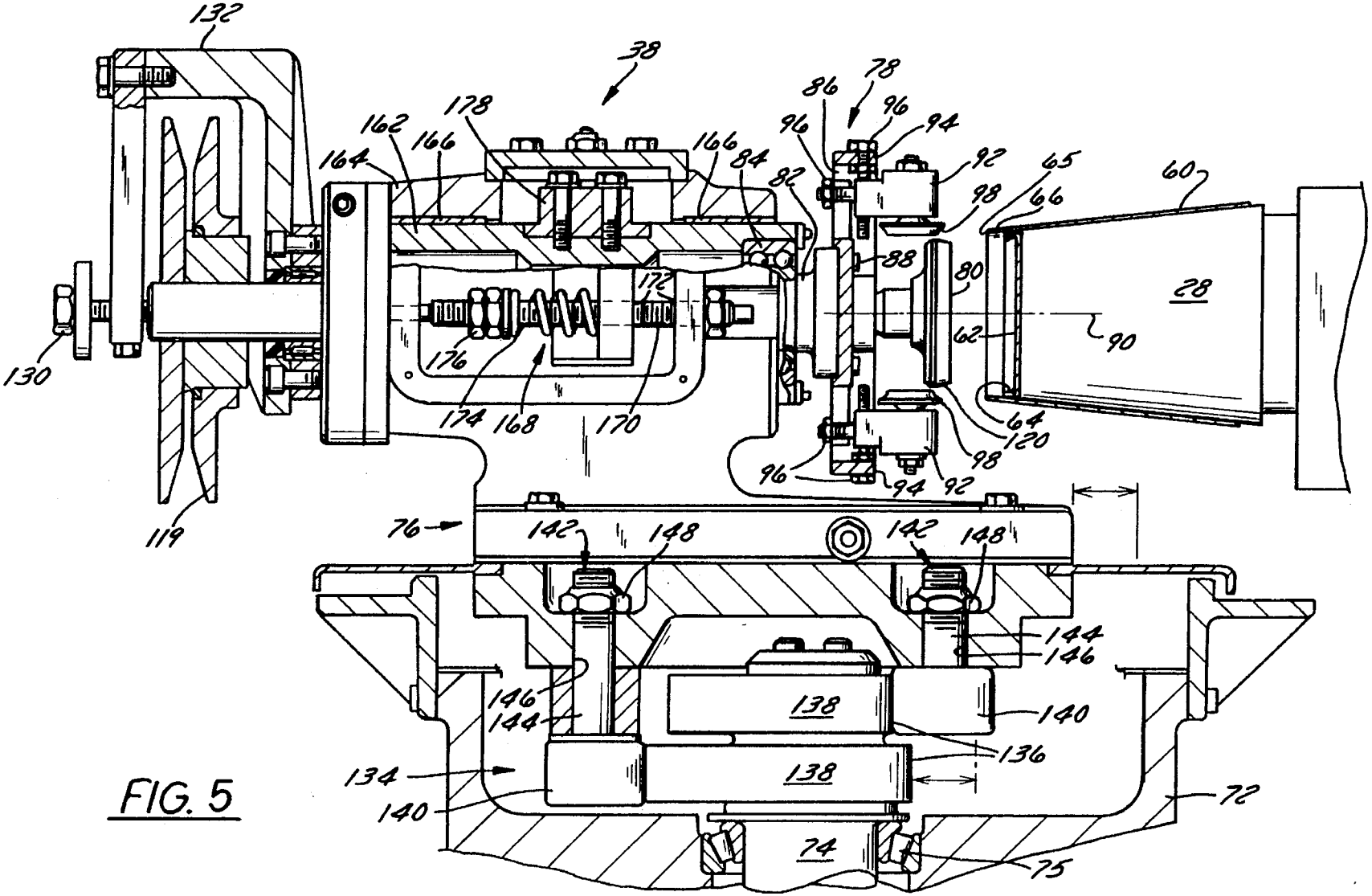
FIG. 5 is a longitudinal cross-sectional view of the cup bottom incurl workstation of the apparatus shown in FIG. 1.
Figure 6:
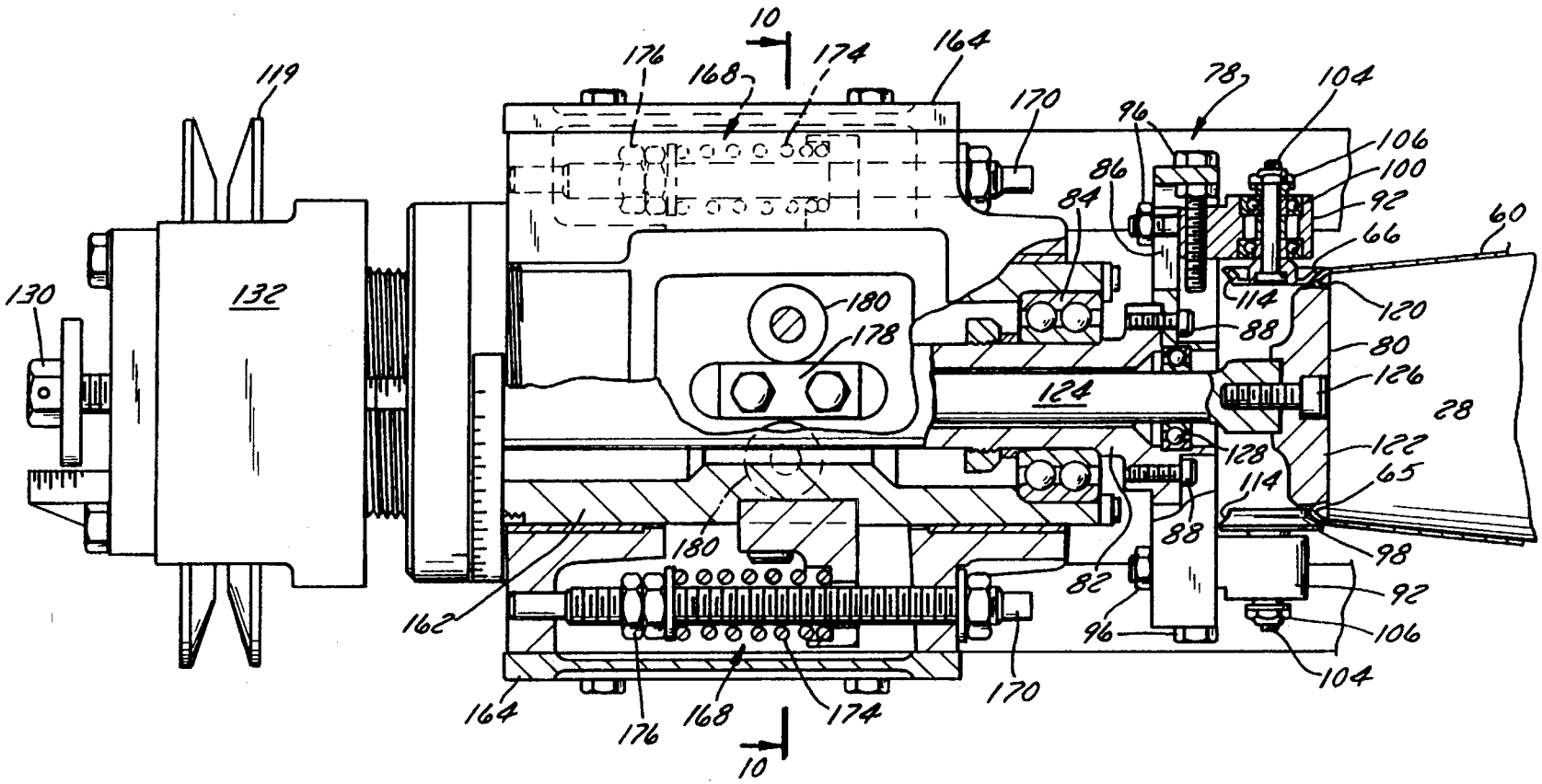
FIG. 6 is a top plan view showing various components in cross section and showing the roller assembly engaging the bottom flap of the sidewall blank.
Figure 7:
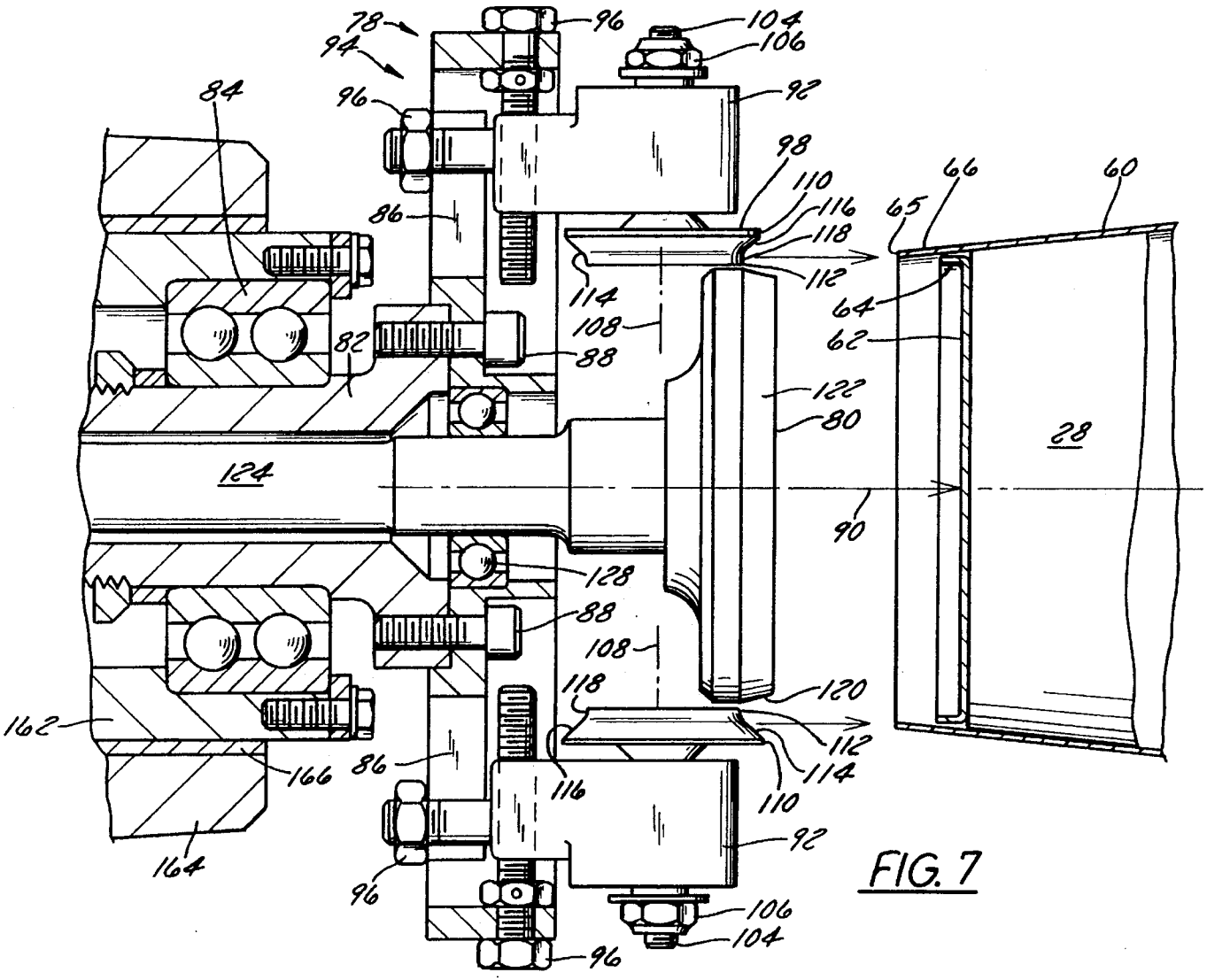
FIG. 7 is a partial cross-sectional view showing the stationary flap guide and the rotatable roller assembly.
Figure 8:
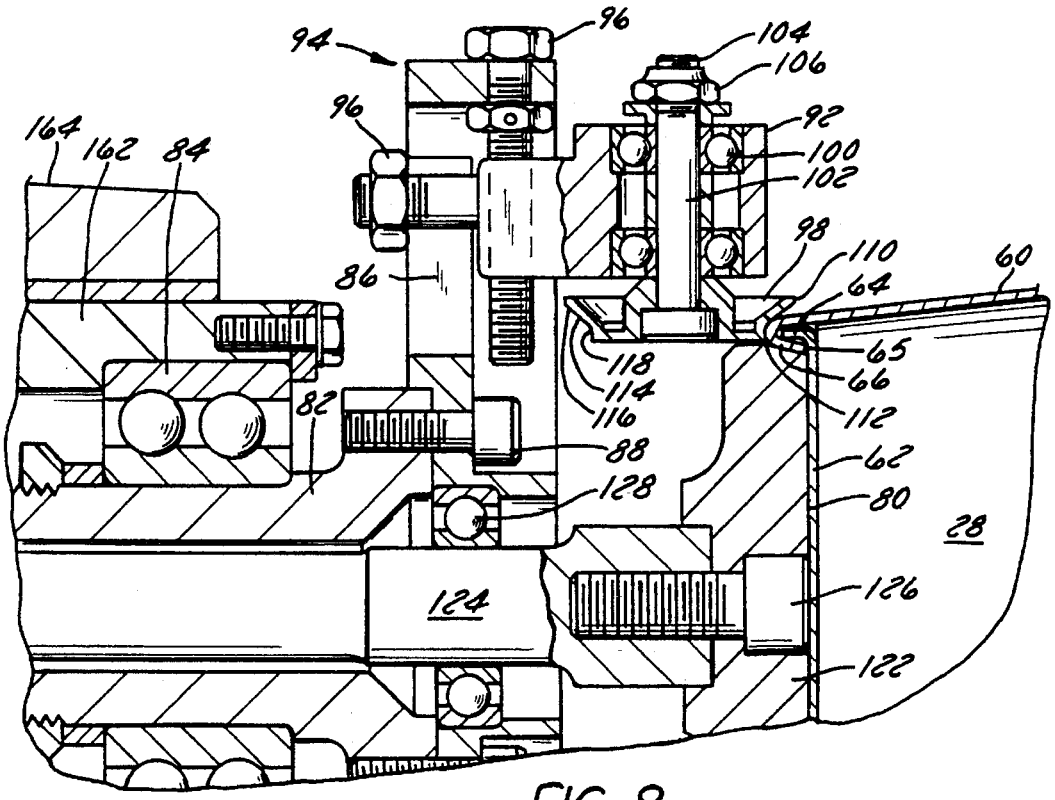
FIG. 8 is an enlarged partial cross-sectional view showing a roller and the central stationary flap guide cooperating to provide an incurl to the bottom flap of the sidewall blank.

As shown best in FIGS. 5 and 6, rotational movement of carriage subassembly 162 with respect to carriage housing 164 is prevented by a guide block 178 connected to carriage subassembly 162. Guide block 178 is held between a pair of guide rollers 180 mounted to carriage housing 164. Thus, carriage assembly 162 can move longitudinally with respect to carriage housing 164, but it cannot rotate with respect to carriage housing 164.

In operation, bottom blank 62 is mounted on the end of mandrel 28 and held in place, typically by a vacuum applied through vacuum orifices in the mandrel (not shown). Sidewall blank 60 is then wrapped around bottom blank 62 and mandrel 28 so flap 66 and bottom edge 65 extend beyond lip 64 of bottom blank 62. As input shaft 74 rotates, cams 136 move cam followers 140 and carriage 76 towards mandrel 28. The rollers 98 are moved into contact with flap 66 at sloped portion 116. As the rollers 98 continually move toward mandrel 28, the bottom edge 65 of flap 66 is forced inwardly along sloped portion 116 and is curled along arcuate portion 118 which directs bottom edge 67 into contact with stationary peripheral surface 120 of central flap guide 80. As carriage 76 continues to move toward mandrel 28, bottom edge 65 is directed into recessed area 70 along peripheral surface 120. In the meantime, roller assembly 78 is continually rotating about axis 90 to provide a consistent curling of flap 66 along the entire bottom of cup 52. Once the incurl is completed, cams 136 move carriage 76 back away from mandrel 28 to permit the next mandrel and its attached bottom blank and sidewall blank to move into proximity with incurl station 38. At subsequent workstations, the curled-in flap is squeezed together with the bottom blank lip and sealed to complete the formation of the bottom of cup 52.

It will be understood that the foregoing description is of a preferred exemplary embodiment of this invention and that the invention is not limited to the specific forms shown. For example, various cam assemblies may be used to reciprocate the carriage, the rollers and central flap guide may have guide surfaces of different configurations depending on the design of the cup and the type of cup material being used, different numbers and sizes of rollers may be used, other roller assembly rotational speeds may work for some applications, the carriage may be mounted on other slide assemblies, and the overall workstation may be driven by a variety of mechanisms. These and other modifications may be made in the design and the arrangement of the elements without departing from the scope of the invention as expressed in the appended claims.

What is claimed is:

1. A paperboard cup bottom incurl workstation useful in combination with a cup making machine having a rotating turret with a plurality of mandrels, each mandrel being coordinated to become a registered mandrel as it moves into a position proximate the bottom incurl station, the registered mandrel being configured to receive a bottom blank having an outer lip and a sidewall blank including a flap that is curled inwardly over the outer lip to create a recessed area in the bottom of the cup, the bottom incurl workstation comprising:

a central flap guide having a peripheral surface; and a rotatable roller assembly having an array of rollers disposed to contact a bottom edge of the flap, each roller being movable along the peripheral surface and having an arcuate surface extending into cooperation with the peripheral surface, wherein as the registered mandrel moves closer to the array of rollers and the flap guide, the bottom edge of the flap is directed inwardly along the arcuate surfaces of the rollers to the peripheral surface which is configured to guide the flap into the recessed area.

2. The paperboard cup bottom incurl workstation as recited in claim 1, wherein the central flap guide is fixed with respect to rotation.

3. The paperboard cup bottom incurl workstation as recited in claim 2, wherein the rollers are rotatable.

4. The paperboard cup bottom incurl workstation as recited in claim 3, wherein each roller is rotatable about a roller axis and each roller axis is generally perpendicular to a longitudinal axis through the central flap guide.

5. The paperboard cup bottom incurl workstation as recited in claim 4, wherein the central flap guide has a generally circular periphery.

6. The paperboard cup bottom incurl workstation as recited in claim 5, wherein each roller has an outer wall and an inner wall, the outer wall extending radially outward from the roller axis a greater distance than the inner wall.

7. The paperboard cup bottom incurl workstation as recited in claim 6, wherein the array of rollers includes at least four rollers.

8. The paperboard cup bottom incurl workstation as recited in claim 7, wherein the rotatable roller assembly rotates about a roller assembly axis, the roller assembly axis being generally perpendicular to the roller axes.

9. The paperboard cup bottom incurl workstation as recited in claim 3, further comprising a movable carriage assembly, the central flap guide and the rotatable roller assembly being mounted to the movable carriage assembly.

10. The paperboard cup bottom incurl workstation as recited in claim 9, wherein the carriage assembly is connected to a cam assembly configured to reciprocate the carriage assembly.

11. A paperboard cup bottom incurl workstation useful in combination with a cup making machine having a rotating turret with a plurality of mandrels, each mandrel being coordinated to become a registered mandrel as it moves into a position proximate the bottom incurl station, the registered mandrel being configured to receive a bottom blank having an outer lip and a sidewall blank including a flap that is curled inwardly over the outer lip to create a recessed area in the bottom of the cup, the bottom incurl workstation comprising:

a central flap guide having a peripheral surface; and a rotatable roller assembly having an array of rollers disposed to contact a bottom edge of the flap, each roller having an arcuate surface extending into cooperation with the peripheral surface, wherein as the registered mandrel moves closer to the array of rollers and the flap guide, the bottom edge of the flap is directed inwardly along the arcuate surfaces of the rollers to the peripheral surface which is configured to guide the flap into the recessed area;

further wherein the central flap guide is fixed with respect to rotation, and the rollers are rotatable;

the paperboard cup bottom incurl station further comprising:

a movable carriage assembly, wherein the central flap guide and the rotatable roller assembly are mounted to the movable carriage assembly and the carriage assembly is connected to a cam assembly configured to reciprocate the carriage assembly; and a spring release mechanism that allows a portion of the carriage assembly to move when sufficient force is applied longitudinally against the central flap guide.

12. A container bottom incurl workstation useful in combination with a container making machine having a rotating turret with a plurality of mandrels, each mandrel being coordinated to become a registered mandrel as it moves into a position proximate the bottom incurl station, the registered mandrel being configured to receive a bottom blank having an outer lip and a sidewall blank including a flap that is curled inwardly over the outer lip to create a recessed area in the bottom of the container, the bottom incurl workstation comprising:

a framework;

a carriage assembly movably mounted on the framework;

a roller assembly rotatably mounted in the carriage assembly for rotation about a roller assembly axis, the roller assembly including a support plate and at least two rollers mounted to the support plate at a position radially outward from the roller assembly axis, wherein each roller includes a surface for guiding the bottom edge of the flap as the roller assembly and registered mandrel are moved towards one another; and a central flap guide including a peripheral surface that cooperates with the roller surfaces to curl the flap back into the recessed area, the central flap guide being fixed with respect to rotation about the roller assembly axis.

13. The container bottom incurl workstation as recited in claim 12, wherein each roller is rotatable about a roller axis and each roller axis is oriented generally transverse to the roller assembly axis.

14. The container bottom incurl workstation as recited in claim 13, wherein each roller has a first wall and a second wall generally parallel to the first wall, the second wall having an end adjacent the peripheral surface and having a diameter less than the diameter of the first wall.

15. The container bottom incurl workstation as recited in claim 12, wherein each roller has an arcuate surface disposed to contact the bottom edge and configured to direct the bottom edge to the peripheral surface.

16. A method for forming the bottom of a container having a bottom blank and a sidewall blank, comprising the steps of:

creating a lip on the bottom blank;

wrapping a sidewall blank around the bottom blank so a sidewall blank flap having a bottom edge extends beyond the lip;

forcing the bottom edge against a plurality of rollers having arcuate surfaces to direct the bottom edge inwardly;

moving the rollers along the bottom edge; and forcing the bottom edge against a surface that is stationary with respect to the direction of movement of the rollers and configured to direct the bottom edge back towards the bottom blank.

17. The method as recited in claim 16, further comprising the step of squeezing the bottom edge against the lip.

18. The method as recited in claim 16, further comprising the steps of:

mounting the plurality of rollers on a reciprocable carriage assembly;

attaching the bottom blank to an end of a mandrel;

wrapping the sidewall blank around the mandrel; and moving the carriage assembly towards the mandrel to force the rollers against the bottom edge.

19. The method as recited in claim 18, wherein the step of mounting the plurality of rollers includes attaching the rollers to a rotatable roller assembly.

20. The method as recited in claim 19, further comprising the step of forming the stationary surface in a generally circular pattern.

* * * * *